US008500078B2

(12) United States Patent
Castellanos

(10) Patent No.: US 8,500,078 B2
(45) Date of Patent: Aug. 6, 2013

(54) BRACKET AND BRACKET ASSEMBLY

(76) Inventor: Peter Castellanos, Gold Coast (AU)

( * ) Notice: Subject to any disclaimer, the term of this patent is extended or adjusted under 35 U.S.C. 154(b) by 268 days.

(21) Appl. No.: 12/989,143

(22) PCT Filed: Apr. 22, 2009

(86) PCT No.: PCT/AU2009/000495

§ 371 (c)(1),
(2), (4) Date: Oct. 22, 2010

(87) PCT Pub. No.: WO2009/129565

PCT Pub. Date: Oct. 29, 2009

(65) Prior Publication Data

US 2011/0036963 A1 Feb. 17, 2011

(30) Foreign Application Priority Data

Apr. 24, 2008 (AU) ..... 2008902025

(51) Int. Cl.
*A47F 5/08* (2006.01)

(52) U.S. Cl.
USPC ..... 248/339; 248/223.41; 211/87.01

(58) Field of Classification Search
USPC ..... 248/339, 223.41, 224.51, 224.61, 248/304, 307, 231.91, 235, 241, 242, 243; 211/87.01, 90.01, 90.02, 106.01; 403/381
See application file for complete search history.

(56) References Cited

U.S. PATENT DOCUMENTS

| | | | | |
|---|---|---|---|---|
| 2,908,471 | A * | 10/1959 | McFerrell Hollansworth | 248/247 |
| 3,695,569 | A * | 10/1972 | Pullan | 248/235 |
| 3,702,591 | A | 11/1972 | Banse | |
| 3,774,788 | A * | 11/1973 | Sowers et al. | 414/543 |
| 4,071,216 | A * | 1/1978 | Einhorn | 248/282.1 |
| 4,306,702 | A * | 12/1981 | Martin | 248/546 |
| 5,078,279 | A | 1/1992 | Hancock et al. | |
| 5,351,842 | A | 10/1994 | Remmers | |
| D373,719 | S * | 9/1996 | Lin | D8/373 |
| 2002/0125389 | A1 * | 9/2002 | Chu | 248/235 |
| 2004/0051015 | A1 | 3/2004 | Ohrling | |
| 2004/0238702 | A1 | 12/2004 | Britten et al. | |

* cited by examiner

*Primary Examiner* — Terrell McKinnon
*Assistant Examiner* — Steven Marsh
(74) *Attorney, Agent, or Firm* — Shoemaker and Mattare

(57) ABSTRACT

A modular bracket (10) comprising a mounting portion (11) adapted to be mounted to a vertical or horizontal surface and an arm (13) extending from the mounting portion (11), the arm (13) having a coupling formation (23) at its free end for coupling to a further member having a complementary coupling (28). The further member may comprise a hook member (25) which may extend substantially linearly from the arm (13) or be inclined downwardly. In another embodiment the further member includes an arm having a plurality of hooks for supporting fishing rods.

19 Claims, 6 Drawing Sheets

BRACKET AND BRACKET ASSEMBLY

TECHNICAL FIELD

This invention relates to a bracket and more particularly to a modular bracket for use in forming a bracket assembly for supporting various articles or objects. In one aspect, a bracket assembly formed with the modular bracket may support a bicycle. In another aspect, a bracket assembly formed with the bracket may support a surfboard. In yet another aspect, a bracket assembly formed with the bracket may support fishing rods.

BACKGROUND ART

A number of different designs and types of brackets for supporting various objects are currently available and used. Brackets for supporting shelves typically are of a right angled configuration and may be unbraced or braced for carrying larger loads. Brackets are usually constructed in one piece of metal or plastics and therefore are generally limited in their application. Other brackets are particularly designed to suit the application to which they are put for example to suit a particular article or object. Thus brackets for supporting or carrying fishing rods are particularly designed for that purpose and have no other purpose. Similarly, brackets for supporting surfboards or bicycles typically can be put to no other use. There is a need therefore to provide a bracket which may be simply adapted for use in supporting various articles.

SUMMARY OF THE INVENTION

The present invention thus aims to provide a modular bracket which may be combined with other components to form bracket assemblies for use in a number of different applications. Other objects and advantages of the invention will become apparent from the following description.

The present invention thus provides a modular bracket comprising a mounting portion adapted to be mounted to a surface, an arm extending from said mounting portion, and first coupling means at the free end of said arm for coupling to a further member having complementary second coupling means for forming a bracket assembly.

The first and second coupling means suitably form a dovetail joint between the arm and further member. Suitably the coupling means comprises a dovetail recess and a complementary male dovetail. Suitably the first coupling means comprises a dovetail recess and the second coupling means comprises a complementary male dovetail. Preferably the first coupling means extends at an acute angle to the mounting portion. The dovetail recess may be formed on the arm or mounting portion and similarly the complementary male dovetail may be formed on the mounting portion or arm.

The mounting portion suitably comprises a mounting flange and the arm suitably extends in a plane normal to or at right angles from the mounting flange. Preferably the dovetail recess is formed in a surface extending at an acute angle to the mounting flange.

Preferably the arm includes an upper arm portion and a lower arm portion and a coupling arm portion extending between the upper arm portion and lower arm portion and including the dovetail recess. The terms "upper" and "lower" as used herein in relation to the arm portions define the position of the respective arm portions when the arm of the bracket is in an orientation extending substantially horizontally. Preferably the upper arm portion is longer than the lower arm portion and the coupling arm portion extends at an acute angle, typically 45 degrees, to the upper arm portion. Preferably the lower arm portion is angled upwardly towards the upper arm portion. Preferably the dovetail recess extends longitudinally along the coupling arm portion. Preferably the arm portions are of a T-shaped cross section comprising a web portion lying in a vertical plane and a flange portion extending substantially at right angles to the web portion. Preferably the web portion may also extend along the mounting portion.

The bracket may be coupled to a hook member which comprises the further member to form a bracket assembly for supporting bicycles or any other article. The hook member may have an arm, a hook at one end of the arm and the second coupling means at the opposite end of the arm for coupling to the first coupling means on the bracket. The hook member may be coupled to the bracket to extend outwardly therefrom and constitute an extension of the arm of the bracket member for upright surface mounting. Alternatively the hook member may be coupled to the bracket to extend at substantially right angles to the bracket arm for ceiling or horizontal surface mounting.

The present invention thus in another aspect provides a bracket assembly for bicycles or other article comprising a bracket a hook member described above.

The hook member in a further embodiment may include an elongated arm which terminates in a hook at one end with the second coupling means at it opposite end and oriented such that when coupled with the first coupling means of the bracket to form a bracket assembly, the hook member is inclined outwardly and downwardly relative to a horizontal plane from the bracket oriented for mounting to an upright surface.

A pair of bracket assemblies of this form may be arranged at a spaced part position and in substantially horizontal alignment for supporting a surfboard or any other elongated member therebetween.

The present invention thus in another aspect provides a bracket assembly for surfboards or other elongated member comprising a bracket and a hook member described above.

In another aspect, the bracket may be combined with a holder for forming a bracket assembly for supporting a plurality of fishing rods. The holder may comprise a first arm having the second coupling means at one end for coupling to the first coupling means of the bracket. The holder may also comprise a second arm having a plurality of hooks or other members for supporting respective fishing rods. The second arm may extend from the first arm and suitably at an acute angle to the first arm. The second arm may be attached at its lower end to the wall or upright surface. The second arm may terminate at its free end in a lug for attachment to a wall or other upright surface to form a brace.

The present invention thus in another aspect provides a fishing rod holder assembly comprising a pair of brackets and associated holders as described above adapted to be mounted at spaced part positions and in horizontal alignment with each other.

The bracket and other components of the bracket assemblies are suitably moulded from plastics in an injection moulding process but may be manufactured using an alternative method.

BRIEF DESCRIPTION OF THE DRAWINGS

In order that the invention may be more readily understood and put into practical effect, reference will now be made to the accompanying drawings which illustrate preferred embodiments of the invention and wherein.

DETAILED DESCRIPTION OF THE PREFERRED EMBODIMENT

Figure 1:
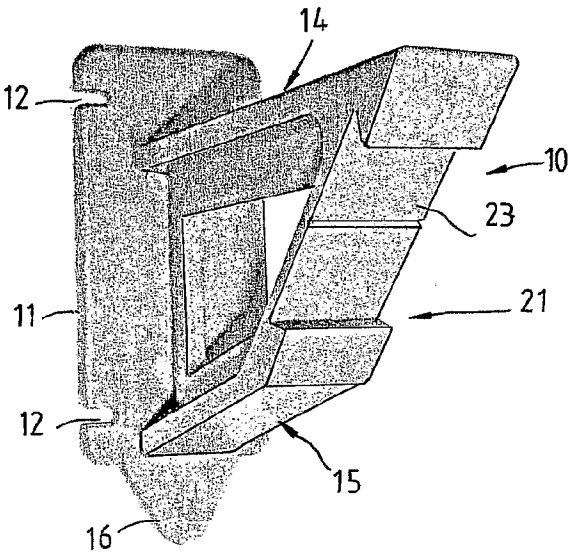
FIG. 1 illustrates a modular base bracket according to an embodiment of the present invention.
Figure 2:
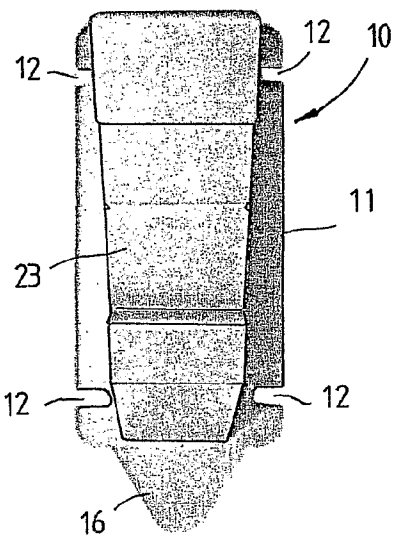
FIG. 2 is a front view of the bracket of FIG. 1.
Figure 3:
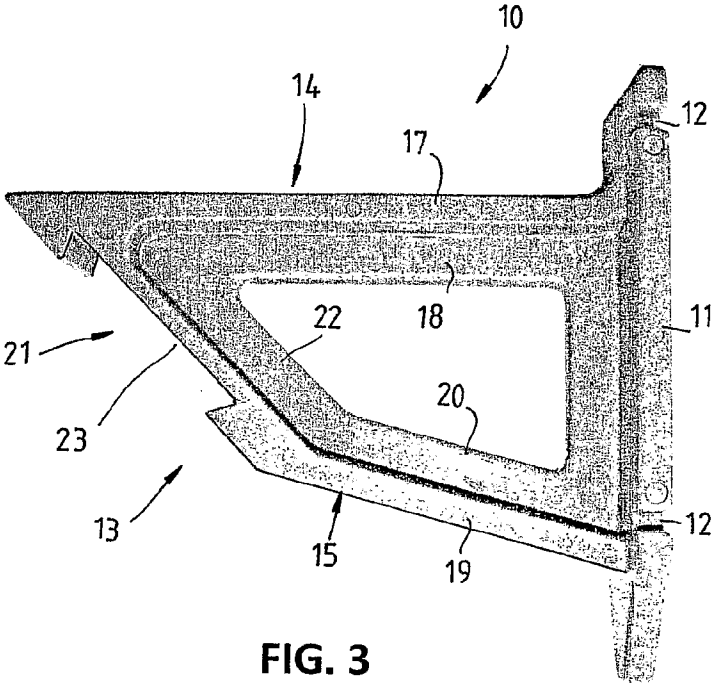
FIG. 3 is a side view of the bracket of FIG. 1.

Referring to the drawings and firstly to FIGS. 1 to 3, there is illustrated a modular base bracket 10 for use in a bracket assembly according to an embodiment of the present invention, the base bracket 10 including a planar mounting flange 11 which is adapted to be mounted to a vertical surface such as a wall surface or a horizontal surface such as a ceiling and which is provided with slots 12 in opposite side edges for receipt of screws or other fasteners for securing the flange 11 to the surface. Extending outwardly from the flange 11 and substantially normal thereto is a bracket arm assembly 13 which comprises a first upper arm 14 and a spaced second lower arm 15 which is angled upwardly towards the upper arm 14. As is apparent, the base flange 11 has a portion 16 which extends downwardly below the lower arm 15 to provide additional support to the base bracket 10 when secured to a mounting surface, the flange portion 16 being of a triangular tapered configuration. The upper arm 13 is of a T-shaped cross section including an upper flange 17 and a central supporting web or flange 18 extending from the underside thereof and the lower arm 15 is of a similar configuration including a lower flange 19 with a supporting flange or web 20 provided on the upper side thereof.

A connecting arm 21 extends between the outer ends of the upper arm 14 and lower arm 15 extending at an acute angle to the arm 14 and typically at 45 degrees to the arm 14. The arm 21 includes a supporting web or flange 22 on its rear side which joins the flanges 18 and 20 to form a continuous stiffening flange for the arm assembly 13. The continuous stiffening web or flange also continues along the inner side of the base flange 11. The outer side of the arm 21 is provided with a dovetail shaped re-entrant recess 23 which has a width, the width of which extends longitudinally of the arm. The recess 23 is adapted to receive a complementary dovetail-shaped coupling of a further member to be connected to the bracket 10 to adapt the bracket 10 for a number of different applications.

Figure 4:
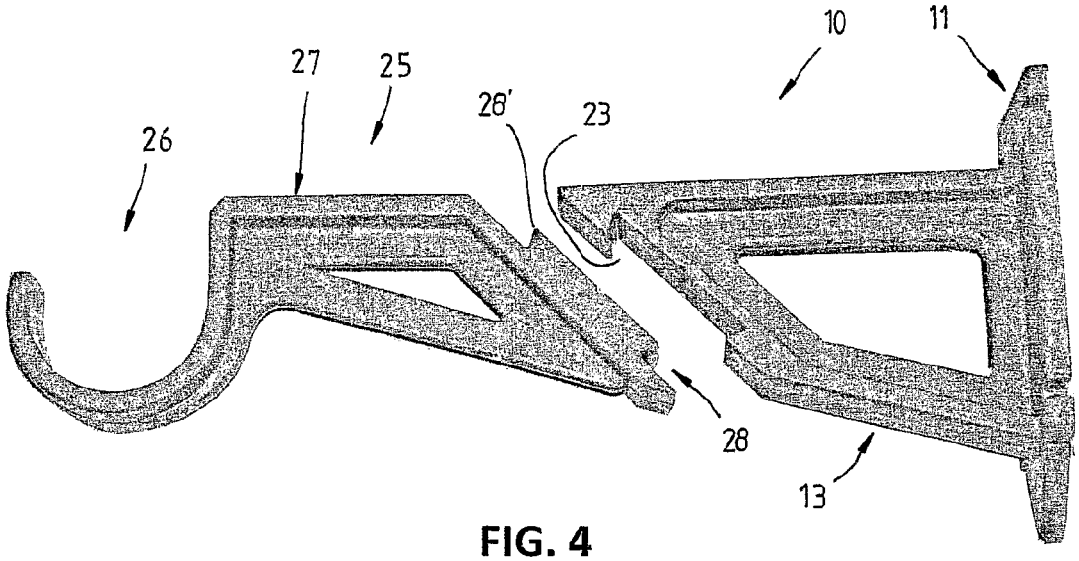
FIG. 4 illustrates in exploded view the bracket and associated hook member of one embodiment.

FIG. 4 is an exploded view showing the bracket 10 and associated hook member 25 for connection to the bracket 10, the member 25 having a hook 26 at one end, an arm 27 extending rearwardly from the hook 26 and terminating in a coupling 28 for coupling to the bracket 10, the coupling 28 having a mail dovetail coupling member 28' complementary to the dovetail recess 23. The coupling 28 is angled at the same angle as the bracket arm 21 such that when the coupling member 28' is received in the recess 23 as in FIG. 5, the hook member 25 comprises a linear extension of the bracket 10 with the arm 27 comprising a continuous extension of the arm 13 of the bracket 10.

For connection, the coupling member 28' of the hook member 25 is slid sideways into the recess 23 so as to be retained therein. The connection suitably comprises a push fit such that the hook member 25 and bracket 10 are firmly interconnected. The arm 27 of the hook member 25 includes acutely angled upper and lower arms portions which connect to the hook 26 at one end and which are angled at the same angle as the arms 13 and 14 and effectively comprise extensions of the arms 13 and 14. At the coupling 28, the upper and lower arm portions are spaced apart substantially the same distance as the arms 13 and 14 at the coupling 23. The acutely angled arm 21 of the bracket 10 provides an enlarged surface to carry loads applied to the hook 26 and further distributes the load along both arms 14 and 15 to the wall surface to which the bracket 10 is mounted.

Figure 5:
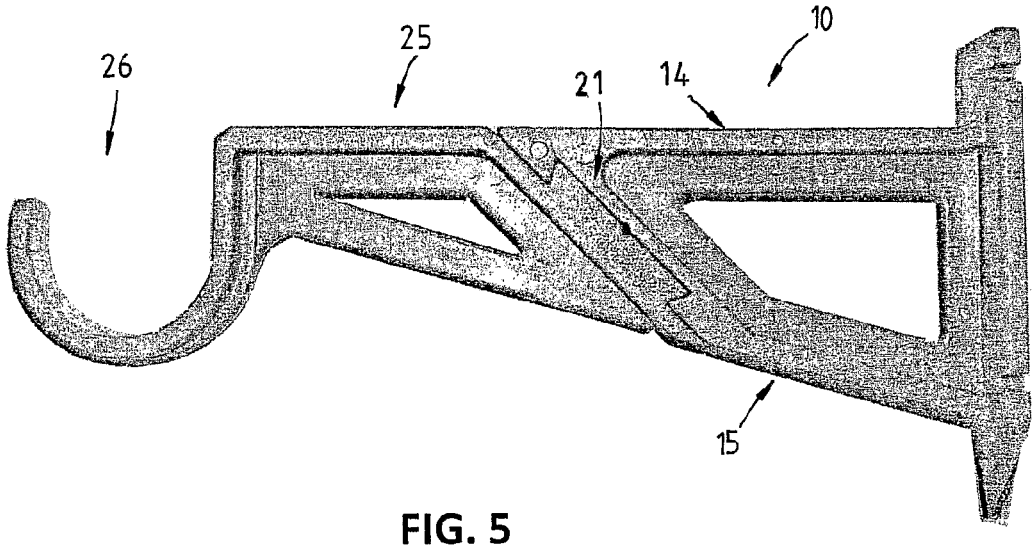
FIG. 5 illustrates the bracket and connected hook member of FIG. 4 in a first configuration for wall mounting.

The bracket 10 with assembled hook member 25 forms a bracket assembly as shown in FIG. 5 which may be mounted to a vertical wall surface by suitably fasteners such as screws passed through the slots 12 into the wall. Where the wall is timber or where the bracket 10 is to be secured to a stud or other timber member, screws can be driven through the flange 11 and extension portion 16 thereof into the stud or other member. The bracket assembly is typically suited for storage of bicycles on a wall with the top rail of the bicycle being hooked over and being supported by the hook 26. Alternatively a pair of bracket assemblies as described may be mounted to a wall at spaced apart positions to support the top rail of the bicycle.

Figure 6:
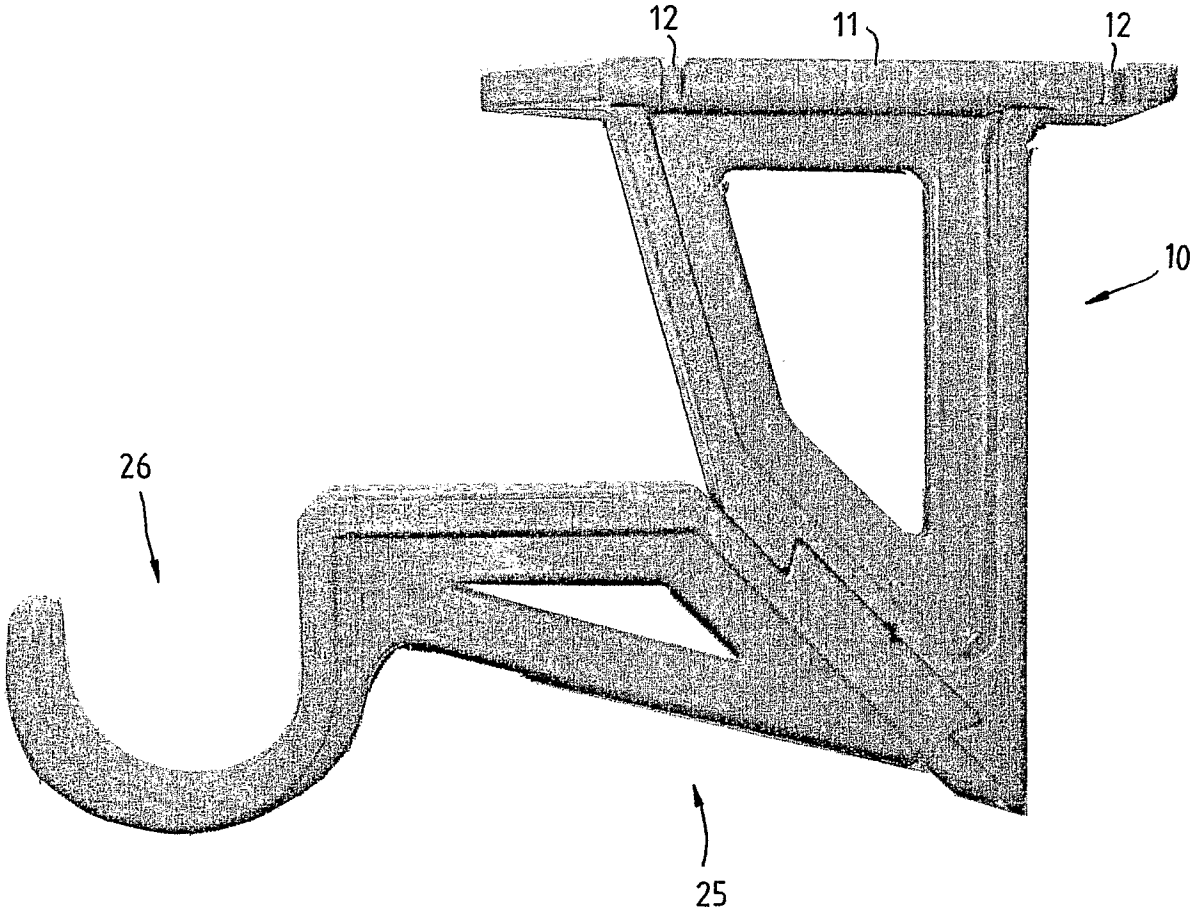
FIG. 6 illustrates the bracket and connected hook member of FIG. 4 in a second configuration for ceiling mounting.

In the embodiment of FIG. 6, the hook member 25 is reversed from its attitude of FIGS. 4 and 5 such that when connected to the bracket 10, it extends substantially at right angles to the bracket 10. In this embodiment, the flange 11 of the bracket 10 may be secured to a ceiling or other horizontal surface by fasteners passed through the slots 12 and/or fasteners driven through the flange 11 and a bicycle may be hung from the hook 26 for example by its wheel.

Figures 7, 8:
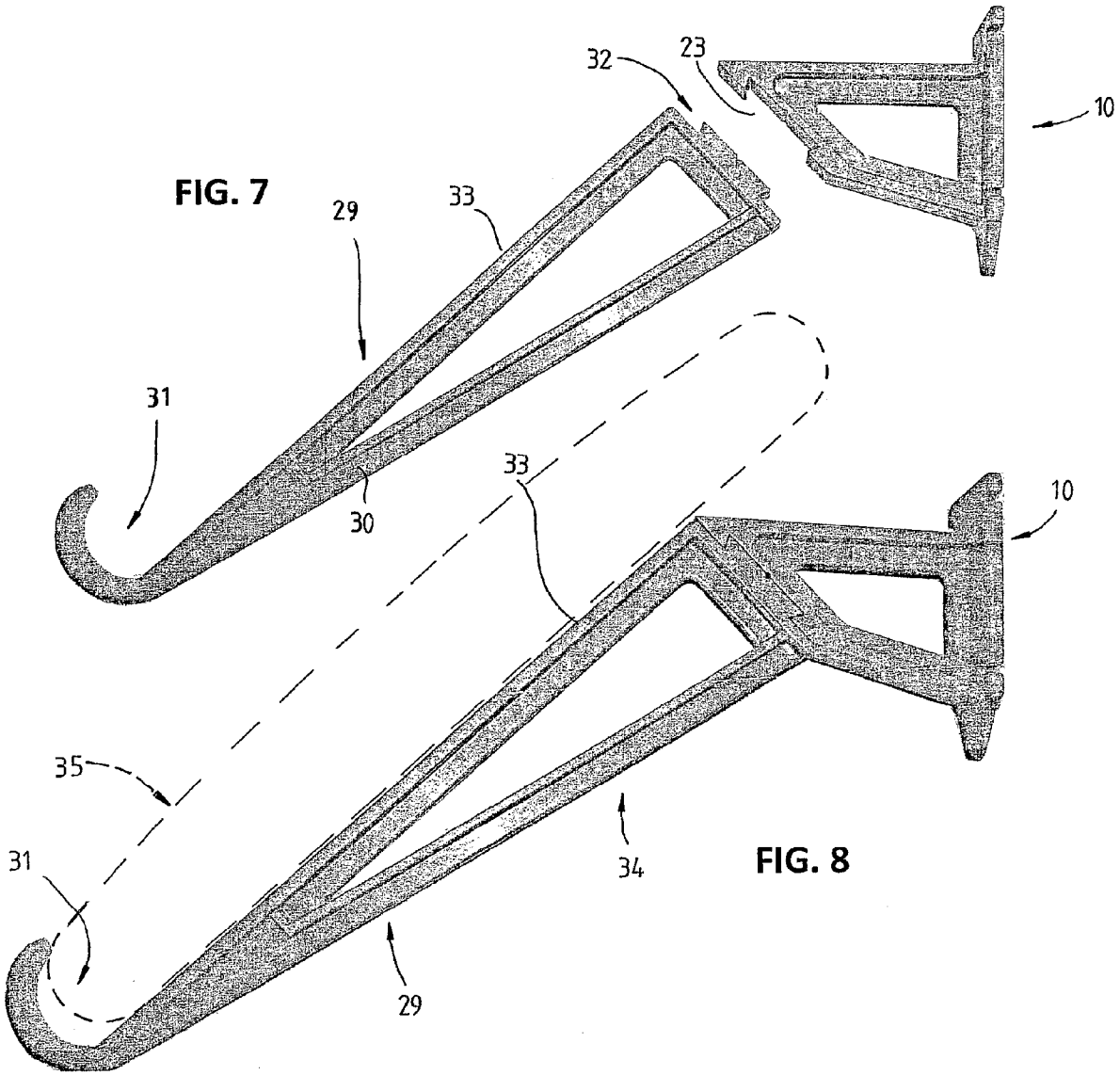
FIG. 7 illustrates in exploded view the bracket and associated hook member of a second embodiment.
FIG. 8 illustrates the bracket and connected hook member of FIG. 7.

FIG. 7 illustrates the bracket 10 associated with a further embodiment of hook member 29 which includes an elongated arm 30 or similar configuration to the arm 27 terminating at one end in a hook 31 and at its opposite end in a coupling 32 of dovetail configuration adapted to be coupled to the bracket 10 via the dovetail recess 23. The coupling 32 however is angled in this case at approximately 90 degrees to the top surface 33 of the arm 30 such that when the coupling 32 is engaged in the recess 23 as shown in FIG. 8 to form the bracket assembly 34, the arm 30 is angled downwardly relative to a horizontal plane at an acute angle.

The bracket assembly 34 is particularly suited to mounting to a vertical surface such as a wall surface for supporting surfboards or other elongated members. Thus the respective brackets 10 of a pair of bracket assemblies 34 may be secured at spaced apart positions and in substantially horizontal alignment to a vertical wall surface such that the hook members 29 of the respective bracket assemblies 34 are inclined downwardly. A surfboard 35 shown in dotted outline in FIG. 8 may then be positioned on the respective top surfaces 33 of the arms 30 to be supported thereby and by the hook 31 at the end of the arms 30.

Figure 9:
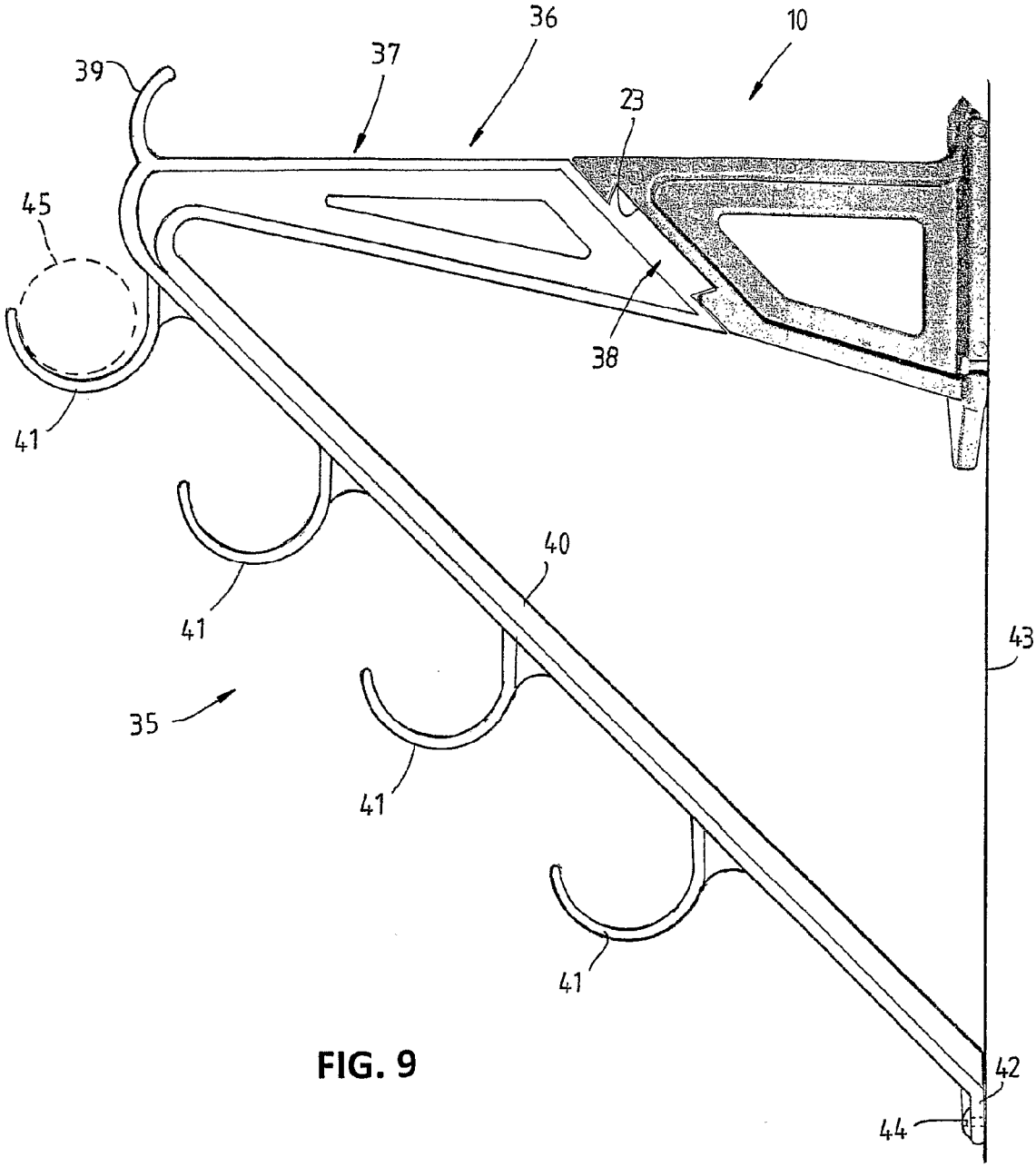
FIG. 9 illustrates the bracket of FIGS. 1 to 3 with a connected holder for fishing rods.

Referring now to FIG. 9, there is illustrated a further embodiment of the invention comprising a bracket assembly 35 for fishing rods or other elongated member and including a bracket 10 and a rod holder 36. The holder 35 includes an upper arm 37 which is similar to the arm 27 of the hook member 25 of FIG. 1 and which has a dovetail male coupling 38 for receipt in the dovetail recess 23 of the bracket 10 and which is angled such that the arm 37 extends substantially horizontally outwardly of the bracket 10. An upwardly extending hook 39 is proved at the outer end of the arm 37. A further return arm 40 extends from the outer end of the arm 37 and at an acute angle thereto, the arm 40 being formed integrally with the arm 37. A series of hooks 41 (in these case four hooks) are provided at spaced positions along the arm 40 and the arm 40 terminates at its lower end in a mounting lug 42. The hooks 41 are of arcuate form and open upwardly to form a support for an elongated member such as a fishing rod.

The bracket 10 may be secured to a vertical surface 43 as described above and the lug 42 may also be secured to the surface 43 such as by a screw or other fastener 44 passed through the lug 42 to support the arm 40 and form a bracing for the bracket assembly 35. It will be noted that the hooks 41 are offset horizontally from each another.

A pair of bracket assemblies 35 may be mounted to the wall surface 43 at spaced apart positions and in substantially horizontal alignment and respective fishing rods may be located in and supported by spaced hooks 41 as shown at dotted outline at 45. As the hooks 41 along the arm are offset from each other, the reel carried by one fishing rod will not interfere with the reel carried by an adjacent fishing rod.

Whilst it is preferred that the arm 40 is attached by the lug 42 to a wall surface, this may not be necessary in all circumstances.

The holder 35 in the preferred embodiment is moulded of plastics in an injection moulding process with the components integrally formed but it may be moulded or fabricated using other manufacturing processes. The holder 35 may also include any number of rood holding hooks 41 as is practical. A further rod or rods may also be supported on the arm 37 of the holder 35 to be retained by the hook 39 at the end of the arm 37. The hooks 41 may be replaced by other holding devices such as clips, clamps, or shelving members for holding or supporting other elongated articles.

Figure 10:
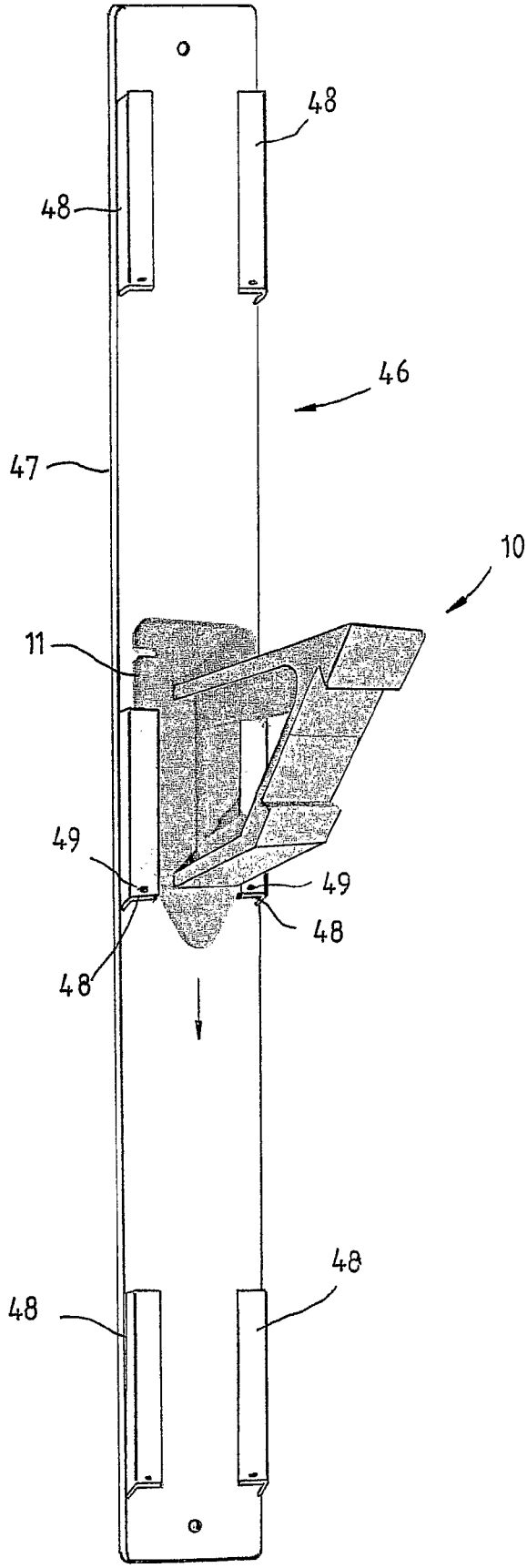
FIG. 10 illustrates an alternative manner of mounting the modular base brackets one above the other.

FIG. 10 illustrates an alternative manner of supporting a plurality of the mounting brackets 10 one above the other. As shown a mounting bracket 46 having an elongated rectangular planar base flange 47 is proved along opposite edges with inwardly directed opposing L-shaped lugs 48 which define with the base flange channels into which the base flange 11 of a bracket 10 may be slid in the direction of the arrow in FIG. 10 to be captured between the lugs 48, the lugs 48 having stops 49 at their lower ends to provide support to the base flanges 11. In the illustrated embodiment, the bracket 46 has three sets of opposing lugs 48 and thus can carry three modular brackets 10 but may include any number of lugs 48. The bracket 46 may be secured in any suitable manner to a vertical surface such as by adhesives or fasteners driven through apertures in the flange 47. The bracket 46 may support spaced bracket assemblies of the type shown in FIGS. 4 and 5, 7 and 8 and 9.

Whilst the coupling means between the bracket parts are preferably of a dovetail configuration defined by a re-entrant recess and a complementary shaped projection, other forms of coupling means may be used.

The terms "comprising" or "comprise" or derivatives thereof as used throughout the specification and claims are taken to specify the presence of the stated features, integers and components referred to but not preclude the presence or addition of one or more other feature/s, integer/s, component/s or group thereof.

The above has been given by way of illustrative embodiment of the invention however all variations and modifications as would be apparent to persons skilled in the art are deemed to fall within the broad scope of the invention as defined in the claims.

The invention claimed is:

1. A modular bracket comprising a mounting portion adapted to be mounted to a surface, an arm assembly extending from said mounting portion, said arm assembly comprising a first upper arm, said first upper arm having an inner end connected to said mounting portion and an outer end, a second lower arm, said second lower arm having an inner end connected to said mounting portion and an outer end, and a connecting arm extending between and being connected to said outer ends of said first and second arms, said connecting arm extending at an acute angle to said first arm and first coupling means on said connecting arm, said first coupling means being adapted to cooperate with a complementary second coupling means of a further member, wherein said first and second coupling means comprise a dovetail recess and a complementary male dovetail for forming with said further member a bracket assembly.

2. A modular bracket as claimed in claim 1 wherein said first coupling means comprises a dovetail recess and the second coupling means comprises a complementary male dovetail.

3. A modular bracket as claimed in claim 1 wherein said mounting portion comprises a mounting flange and wherein said first and second arms extend in a plane normal to or at right angles from the mounting flange.

4. A modular bracket as claimed in claim 1 wherein the upper arm is longer than the lower arm and wherein said lower arm is angled upwardly from said mounting portion towards the upper arm.

5. A modular bracket as claimed in claim 2 wherein the dovetail recess extends longitudinally along the connecting arm.

6. A modular bracket as claimed in claim 1 wherein said arms are of a T-shaped cross section.

7. A bracket assembly comprising a modular bracket as claimed in claim 1 and a said further member, said further member comprising a hook member.

8. A bracket assembly as claimed in claim 7 wherein said hook member has an arm, a hook at one end of the arm and the second coupling means at the opposite end of the arm for coupling to the first coupling means on the connecting arm.

9. A bracket assembly as claimed in claim 8 wherein said hook member is adapted to be coupled to the bracket to extend outwardly therefrom and constitute an extension of the arm assembly of the bracket member for upright surface mounting.

10. A bracket assembly as claimed in claim 9 wherein said hook member is adapted to be coupled to the bracket to extend substantially at right angles to the bracket arm assembly for ceiling or horizontal surface mounting.

11. A bracket assembly as claimed in claim 7 wherein said hook member includes an elongated arm which terminates in a hook at one end, said elongated arm having said second coupling means at it opposite end and oriented such that when coupled with the first coupling means of the bracket to form the bracket assembly, the arm of said hook member is angled outwardly and downwardly from the bracket.

12. A pair of bracket assemblies of the type defined in claim 1, said mounting portions of said bracket assemblies being adapted to be mounted at spaced part positions and in substantially horizontal alignment for supporting an elongated member therebetween.

13. A bracket assembly for supporting a plurality of fishing rods or other elongated members, said bracket assembly comprising a modular bracket as claimed in claim 1, wherein said further member comprises a holder, said holder having a first arm having the second coupling means at one end for coupling to the first coupling means of the bracket and a second arm having a plurality of hooks or other members for supporting respective fishing rods or elongated members.

14. A bracket assembly as claimed in claim 13 wherein said second arm of said holder extends from the first arm of the holder and at an acute angle to the first arm of the holder.

15. A bracket assembly as claimed in claim 13 wherein said second arm is adapted to be attached at is free end to a wall or other upright surface to form a brace.

16. An integrally molded modular plastics bracket comprising a mounting flange adapted to be mounted to a surface, and an arm assembly extending from said mounting flange, said arm assembly comprising a first and second arm, said first arm being integrally molded with said flange and extending outwardly from said flange, said first arm being of a T-shaped cross section and comprising a main flange and a supporting web or flange extending from the underside of said main flange, said first arm having an outer end, said second arm being below said first arm, said first arm being longer than said second arm, said second arm being of a T-shaped cross section and comprising a main flange and a supporting web or flange on the upper side of said main flange, said second arm having an outer end, and a connecting arm extending between said outer ends of said first and second arms and being integrally formed therewith, said connecting arm being of a T-shaped cross section and comprising a main flange and a supporting web or flange on the inner side of said main flange and joining the supporting webs or flanges of said first and second arms, said connecting arm extending at an acute angle to said first arm and first coupling means on said main flange of said connecting arm, said first coupling means being adapted to cooperate with complementary coupling means of a further member, wherein said first and second coupling means comprise a dovetail recess and a complementary male dovetail for forming with said further member a bracket assembly.

17. A bracket assembly comprising a modular bracket as claimed in claim 16, wherein said further member comprises a hook member, said hook member having an arm, a hook at one end of the arm and the second coupling means at the opposite end of the arm for coupling to the first coupling means, said hook member when coupled to the bracket through said coupling means in a first orientation extending outwardly therefrom with said arm of said hook member constituting an extension of the arm assembly of the bracket member for upright surface mounting of said mounting flange and wherein said hook member when coupled to the bracket through said coupling means in a second orientation, has its arm extending substantially at right angles to the bracket arm assembly for ceiling or horizontal surface mounting of said mounting flange.

18. A bracket assembly for supporting a plurality of fishing rods or other elongated members, said bracket assembly comprising a modular bracket as claimed in claim 16 and a further said member, said further member comprising a holder, said holder having said second coupling means at one end for coupling to the first coupling means of the bracket and an arm having a plurality of spaced hooks or other members thereallong for supporting respective fishing rods or elongated members.

19. A bracket assembly as claimed in claim 18 wherein said arm of said holder has a free end, said free end being adapted to be attached to a wall or other upright surface.

* * * * *